US005265974A

United States Patent [19]

Dargie

[11] Patent Number: 5,265,974

[45] Date of Patent: Nov. 30, 1993

[54] SAFETY NET ASSEMBLY NET AND SYSTEM

[76] Inventor: Roger A. Dargie, 105 Taywood Rd., Auburn, Me. 04210

[21] Appl. No.: 42,452

[22] Filed: Apr. 5, 1993

Related U.S. Application Data

[63] Continuation of Ser. No. 700,554, May 15, 1991, abandoned.

[51] Int. Cl.[5] ..... E01C 11/22; E01C 11/02

[52] U.S. Cl. ..... 404/4; 182/113; 404/54

[58] Field of Search ..... 404/4, 5, 2, 54, 25-26; 141/97; 248/230; 4/487, 607-610; 403/167; 160/330; 182/113, 88

[56] References Cited

U.S. PATENT DOCUMENTS

| | | | |
|---|---|---|---|
| 603,299 | 5/1889 | Vanderman | 4/610 |
| 2,013,635 | 9/1935 | Serafinowicz | 4/487 |
| 2,313,496 | 3/1943 | Adams | 4/607 X |
| 4,136,010 | 1/1979 | Pilié et al. | 404/25 X |
| 4,667,353 | 5/1987 | Zeigler et al. | 4/607 |
| 4,777,673 | 10/1988 | Patterson et al. | 4/608 X |

OTHER PUBLICATIONS

Baynets Safety Systems Brochure, Braintree, Mass.

*Primary Examiner*—Kenneth J. Dorner
*Assistant Examiner*—Nancy P. Connolly
*Attorney, Agent, or Firm*—Auslander & Thomas

[57] ABSTRACT

A safety net assembly and system is provided which includes at least two rods having attaching brackets at their ends. The brackets may be engaged over ledges in a frame that defines an opening over a subterranean work place. A net or webbing is slideably engaged on the rods, so that it may be opened for access and spread to cover the opening, to prevent a person from falling through the opening when the assembly or system is in place. Where there are insets in the ledges, the assembly or system may be left in place without interfering with the placement of a normal cover for the opening.

32 Claims, 3 Drawing Sheets

FIG. 2
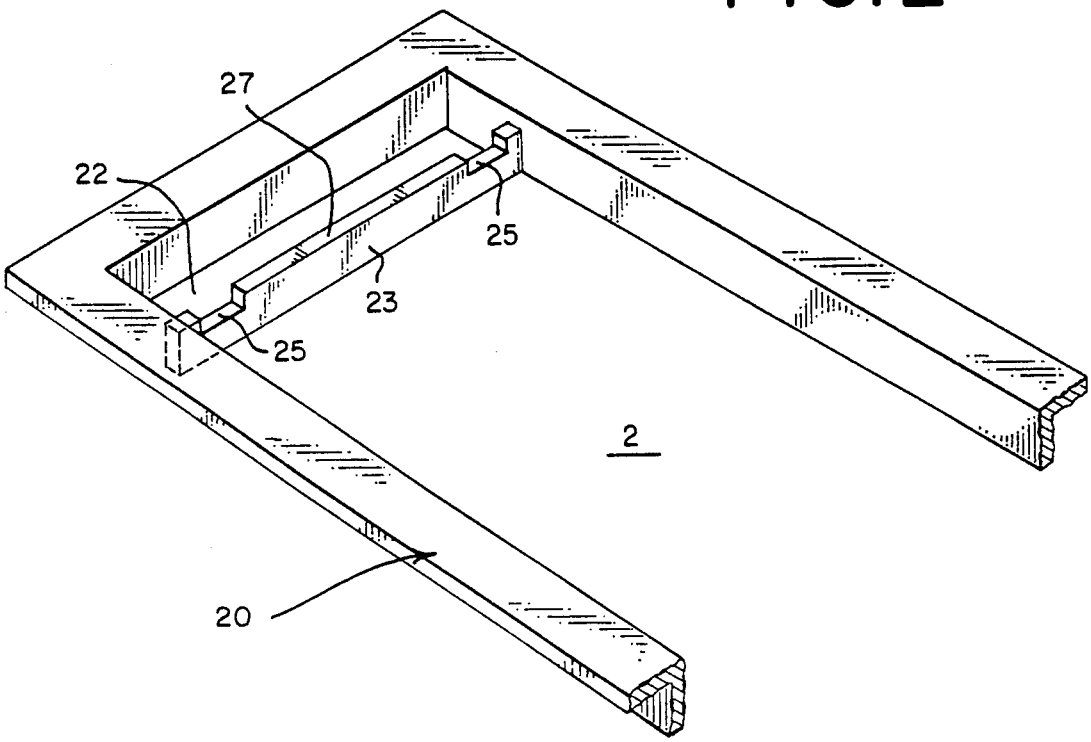
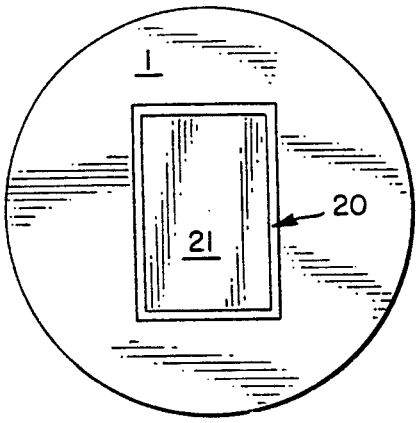
FIG. 1

FIG.3
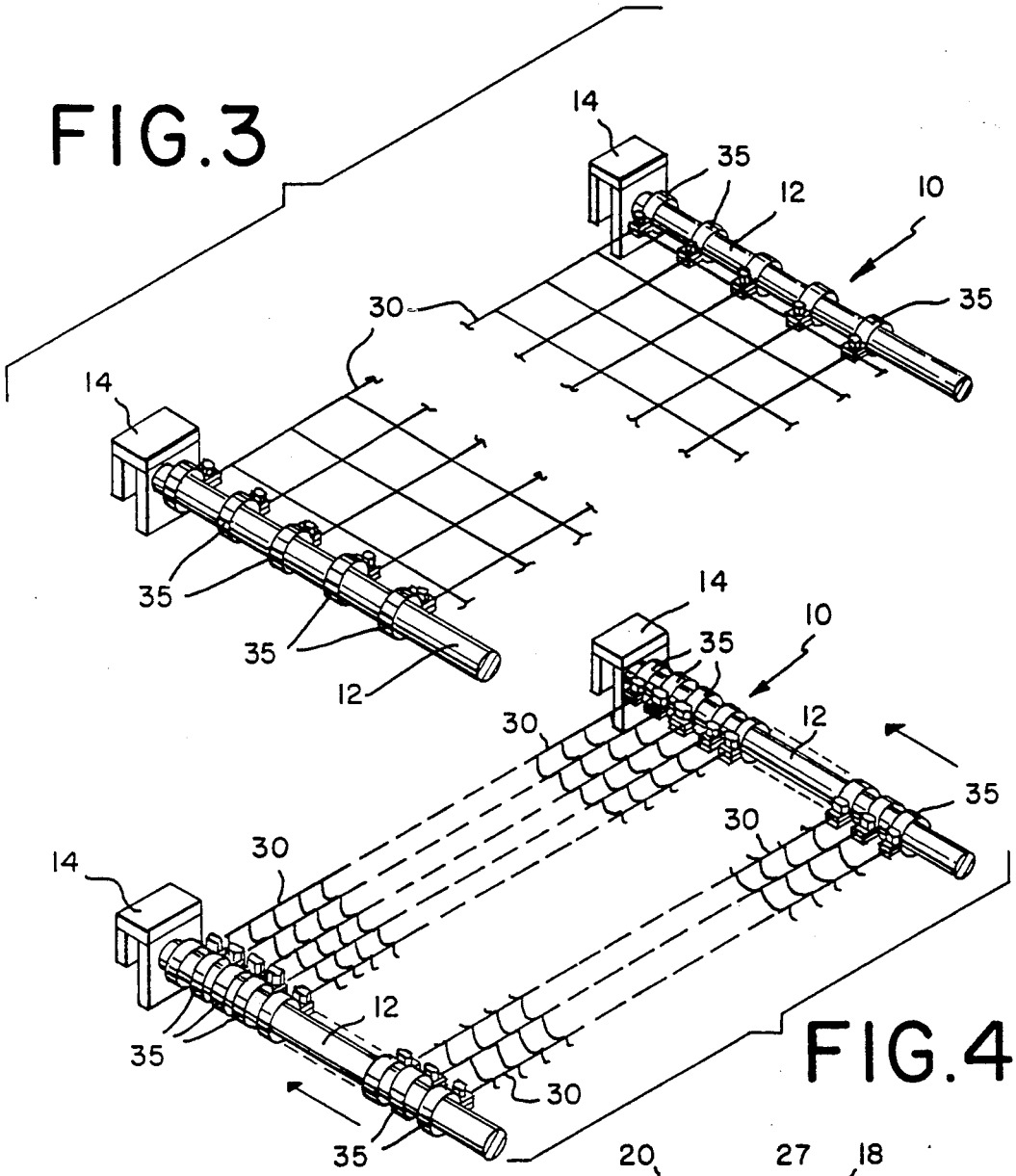
FIG.4
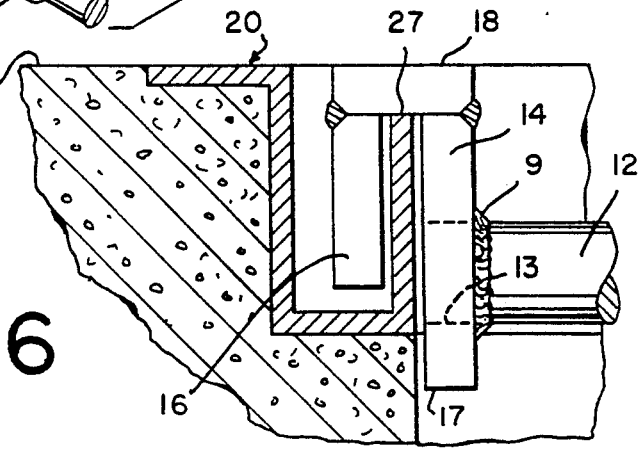
FIG.6

FIG. 7
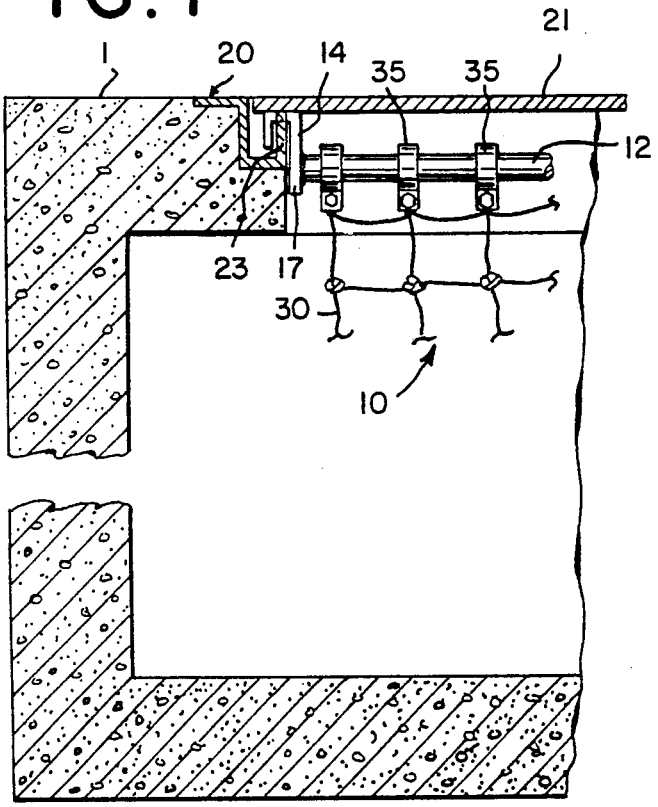
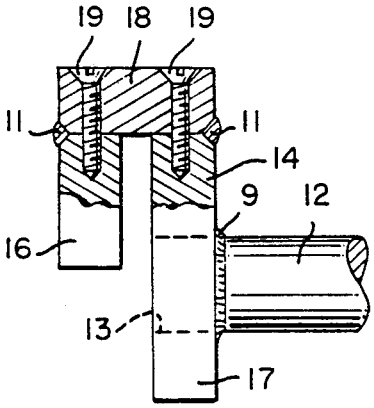
FIG. 5
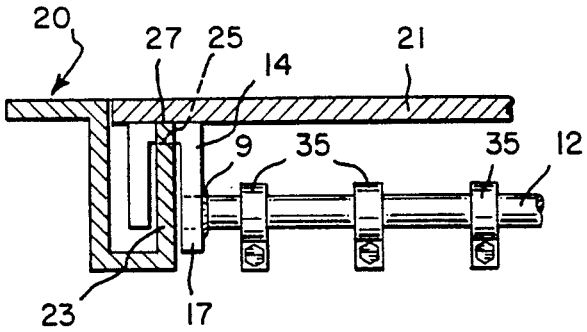
FIG. 8
FIG. 9
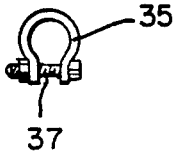

SAFETY NET ASSEMBLY NET AND SYSTEM

This application is a continuation of application No. 07/700,554, filed May 15, 1991, now abandoned.

BACKGROUND OF THE INVENTION

The present invention is a safety net and a safety net system, particularly for use in openings for access to deep well pumping station. The safety net, in the form of a web, is usable in existing deep wet wells and pumping stations, so that upon removal of the hatch cover, the opening is protected, or protectable by the safety net.

Particularly, with regard to deep wet wells and pumping stations, such as for sewage, a rectangular hatch is provided over the opening for access into the working area below.

The hatch is usually a frame with a place for a cover. The hatch is oftentimes flush with the ground.

When gaining access to the inside of the subterranean chamber of the well, pumping station, or the like, once the cover is removed, there is a great danger that someone, or something, may accidentally fall through the opening.

There are numerous pre-existing installations, usually flush with the ground area. Once the worker or workers have access to the space below, it is necessary to keep the hatch cover off to provide light and air in the area below. There was a need for some form of simple, inexpensive safety system to protect the public, and even the workers, when a hatch was open.

Oftentimes, the access to a subterranean system is only necessary for a short period of time, such as for inspection or adjustment. Thus, it was important to have a safety system that could permanently be in place, or that could easily be emplaced when access was required.

DESCRIPTION OF THE RELATED ART

There are various systems available for protecting surface openings, such as hatches or manholes, so that people, or even animals, are not likely to fall in through open hatches. Most of these systems are bulky, expensive and/or complex and generally require the provision of erectable equipment, in order to protect the opening hatch or manhole.

U.S. Pat. No. 830,700 discloses a device to cover the opening in the top of a cistern or catch basin. The device is a complex, elevatable screen, which, when elevated, provides a horizontal netting around the opening. The cover, when tugged, raises the system and maintains itself in a raised position above the opening. The cover may then be opened while the netting is maintained vertically above the level of the opening. The device is effective, but complex to both build and install. Once the cover is opened, even though above ground level, the opening is unprotected.

U.S. Pat. No. 3,461,803 discloses an underground pumping station prefabricated with an access chamber, with access chambers and counterbalance covers which protrude above the ground. Once the covers are opened, even though above ground level, the opening is unprotected.

U.S. Pat. No. 4,248,546 discloses a tent structure for a manhole, including an access chimney, which may be supported on rungs and a manhole frame outside the manhole. Although an above surface structure is provided, no provision is made for protection of the opening.

U.S. Pat. No. 2,576,353 discloses a safety replacement cover for catch basins. The cover is a double system where the main cover is engaged in a frame, which is provided with small openings. While the device protects against the accidental opening of the catch basin, leaving a gaping opening through which someone might fall, it does not make adequate provision for easy ingress and egress, nor provide for safety and easy access, while the entire opening is open.

U.S. Pat. No. 4,919,564 discloses a manhole insert to prevent flooding. The insert does not provide safety protection and easy access to the area inside the manhole.

U.S. Pat. No. 2,958,872 discloses a safety net type covering to cover a swimming pool. The net is exemplary of safety devices involved with covering open areas, such as a swimming pool. The patent also discloses exemplary hooking means for attaching such netting.

U.S. Pat. No. 3,344,440 discloses another pool cover and catching means for engaging the pool cover, which is in the form of a net.

U.S. Pat. No. 3,128,478 is exemplary of a buoyant safety net cover for swimming pools and also discloses a mode for connecting such safety net.

U.S. Pat. No. 3,593,757 is exemplary of netting, specifically for open air water containers, such as swimming pools, having a safety factor in a covering netting.

SUMMARY OF THE INVENTION

The present invention is an installable safety net and safety net system, installable within the hatch, below the hatch of a manhole type access opening covering subterranean structures, such as deep well pumping stations and catch basins.

Permanent installations oftentimes include hatches over the openings of wet wells. The present invention includes an installable net and net support bracket, protecting the opening, once the cover has been removed. The net support brackets are removable, yet may be permanently installed, to always provide safety over the opening, yet easy access to the interior of the space below.

Particularly, where the hatch opening is rectangular, the cover rests upon a ledge in the hatch frame. The net and safety brackets are installable, engaged upon the ledge of the hatch opening.

Where the bracket and safety nets are to be permanently installed, they may be installed in insets in the ledge, which may already be available, or which may be permanently cut into the ledge, so that the brackets and safety net can be permanently installed, yet have the hatch accommodate the cover without any interference from the safety brackets and the net when the cover is installed.

According to the present invention a safety web assembly for horizontal emplacement in a support is provided in an opening over to a subterranean chamber. The safety net assembly has at least two rods with lengths to span the opening. Each rod can be engaged at each end to the support. There is a web between the rods. The web is substantially the length of the rod and the width of said opening. The support may be a frame or it may be rectangular and the support may include a ledge which may have at least one inset. The support may include a trough.

The safety net assembly may include a sliders engaged on the rods which engage the web. The sliders may be clamps or horse shoe clamps which may have closures. The rods may be provided with brackets which may have a short leg, a top, and a depending leg. The short leg and the depending leg may be joined to the top by screw means and the short leg and the depending leg may be welded together.

The web may be slidable along the rods. The web may be a net and may be extendable and retractable along rods.

The present invention may be a safety system for an opening over a subterranean chamber having a support in combination with a safety web assembly. The support is horizontally emplaced in the opening for receiving the safety web assembly. The safety web assembly is horizontally emplaced on the support. The safety web assembly has two rods with lengths that span the opening. Each rod can be engaged at each end to the support. There is a web between the rods. The web is substantially the length of the rod and the width of the opening. The support may be a frame or it may be rectangular and the support may include a ledge which may have at least one inset. The support may include a trough.

The safety net system may include a sliders engaged on the rods which engage the web. The sliders may be clamps or horse shoe clamps which may have closures. The rods may be provided with brackets which may have a short leg, a top, and a depending leg. The short leg and the depending leg may be joined to the top by screw means and the short leg and the depending leg may be welded together.

The web may be slidable along the rods. The web may be a net may be extendable and retractable along rods.

The system may have a cover over the opening.

Although such novel feature or features believed o be characteristic of the invention are pointed out in the claims, the invention and the manner in which it may be carried out, may be further understood by reference to the description following and the accompanying drawing.

BRIEF DESCRIPTION OF THE DRAWING

FIG. 1 is a top plan view of a wet well with a cover in a hatch frame.

FIG. 2 is a broken away detail of the hatch frame.

FIG. 3 is a broken away view of the safety bracket and net assembly for the hatch opening.

FIG. 4 is a broken away view of the net on the bracket with the net retracted.

FIG. 5 is a broken away detail of one embodiment of a net support bracket.

FIG. 6 is a cut away detail of a bracket engaged on a rim within the hatch.

FIG. 7 is a cross sectional detail of the subterranean structure showing the engagement of a safety net assembly emplaced within a hatch opening.

FIG. 8 is a sectional detail of FIG. 7, showing the support bracket engaged in an inset in a ledge of the hatch frame.

FIG. 9 is a detail of an exemplary horse shoe clamp for the attachment of a net.

Referring now to the figures in greater detail, where like reference numbers denote like parts in the various figures.

DESCRIPTION OF THE PREFERRED EMBODIMENTS

The safety net assembly 10 comprises brackets 14, rods 12 and a net 30. There is a bracket 14 at the other end of the rods 12 (not shown) which is a mirror image of its opposite bracket 14. The bracket 14 as can be seen in FIG. 5 is substantially an inverted U having a depending leg 17, a top 18 and a short leg 16. As shown in FIG. 5 the top 18 is joined to the depending leg 17 and the short leg 16 by screws 19. One screw 19 in the top 18 joining the depending leg 17 and another screw 19 joining the short leg 16. A weld 11 further secures the top 18 to the depending leg 17 and another weld 11 secures short leg 16 to the top 18. The rod 12 is secured in an opening 13 in the depending leg 17 by another weld 9.

The net 30 as shown in FIGS. 3, 4 and 7 includes claims 35 which are slidably engaged over the rods 12 engaging the net 30. In a preferred embodiment as shown in detail in FIG. 9, the clamps 35 are horseshoe shaped with a closure 37 at the bottom. Thus the clamps 35 are engagable over the rods 12 and may be secured to the net 30 and the rods 12 by the closure 37.

As shown in FIG. 1, a hatch frame 20 is engage in a top 1 over a subterranean work place. The hatch frame 20 receives a hatch cover 21. The hatch frame 20, as shown in FIG. 2, includes a trough 22 at either end. A second trough 22 (not shown) is at the other end of the hatch frame 20 and is a mirror image of the trough 22 as shown in FIG. 2. The trough 22 includes a ledge 23 with a rim 27. The rim 27 may include insets 25.

OPERATION

In use, the safety net assembly 10 is engaged in an open hatch frame 20. The brackets 14 with the rods 12 and the net 30 are engaged in the trough 22 at either end of the hatch frame 20, spaced apart over the width of the hatch frame 20. The net 30 thus is spread across the opening 2 of the hatch frame 20 as shown in FIG. 3.

The safety net assembly 10 may be part of a permanent installation, as shown in a preferred embodiment in FIG. 7 and 8. In that case, insets 25 are provided in the rim 27 of the ledge 23, into which the brackets 14 may rest with the top 18 of the bracket 14 substantially flush with the rim 27. Thus, when the hatch cover 21 is normally resting on the rim 27, when engaged in the hatch frame 20 there is no interference to the closure since the brackets 14 are on a level with the rim 27.

Access to the subterranean work space is obtained by removing the hatch cover 21, The safety net assembly 10 is then in place. The net then may be pushed aside for access as shown in FIG. 4. Once inside the net 30 is reextended along the length of the rods 12 to protect against a person or animal from inadvertently falling through the opening 2.

In many instances, the ledge 23 in prior existing installations, may not be provided with insets 25. The safety net assembly 10 may be brought to the site and engaged as shown in FIG. 6 once the hatch cover 21 has been removed.

An alternative procedure for permanent installation is to cut insets 25 into already existing ledges 23, so that the safety net assembly 10 can then be left in place when the hatch cover 21 is on, as shown in FIGS. 7 and 8.

The net 30 is preferably of a very strong nylon. The net 30 is engaged on the rods 12 by engaging open clamps 35 over the rods 12 the engaging then sequentially engaging the strands from the net 30 in the clamps 35 and then engaging the closures 37 in the clamps 35.

As shown in FIG. 5 the bracket 14 is an assembled component. The depending leg 17 and the short leg 16 are held together with the top 18 by screws 19 and welds 11. The bracket 14 may or course be a single integral part. The rods 12 are preferably aluminum and welded in the opening 13. The rods 12 of course could be otherwise affixed to the bracket 14 as long as they could be safely affixed. Were the rods 12 safely removably affixed the net 30 might be engagable in relation to the rods 12 by means other than the clamps 35, such as in loops from the net 30 passing around the rods 12. The whole safety net assembly 10 might be of unitary construction.

The terms and expression which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

I claim:

1. A safety web assembly for a ground level hatch frame opening over a subterranean chamber, said hatch frame opening including internal support means, said internal support means for supporting a hatch frame cover thereover, said safety web assembly for horizontal emplacement over said internal support means, said safety web assembly comprising at least two rigid rods, said at least two rigid rods having lengths to span said hatch frame opening, each said rigid rod having a first end and a second end, each said end including attaching means, said attaching means securely engageable with said internal support means, web means, said web means openwork and slidably engaged on said at least two said rigid rods between said ends, said web means having substantially the length and width of said hatch frame opening, and said web means slidable on said rigid rods to optionally cover said hatch frame opening or to uncover said hatch frame opening.

2. The invention of claim 1 wherein said internal support means is rectangular.

3. The invention of claim 1 wherein said internal support means includes at least one ledge.

4. The invention of claim 3 wherein said at least one ledge includes at least one declivity for receiving a rod end attaching means securely engaged therein.

5. The invention of claim 1 wherein said internal support means includes at least one trough.

6. The invention of claim 1 including slideable attaching means, said slideable attaching means engaged on at least two said rods, said web means engaged by said slideable attaching means and slideable along said at least two said rods.

7. The of claim 6 wherein said slidable attaching means is a clamp.

8. The invention of claim 7 wherein said clamp is a horse shoe clamp.

9. The invention of claim 8 wherein said horse shoe clamp includes a closure.

10. The invention of claim 6 wherein said web means is a net.

11. The invention of claim 1 wherein at least one of said rod end attaching means is a bracket.

12. The invention of claim 11 wherein said bracket is in a substantially inverted U shape.

13. The invention of claim 12 wherein said bracket includes an outside short leg, a top leg, said top leg connected to said outside short leg, and a depending leg spaced away from said outside short leg and depending from said top leg, said depending leg attached to one of said rigid end.

14. The invention of claim 13 wherein said outside short leg and said depending leg are joined to said top leg by screw means.

15. The invention of claim 13 wherein said outside short leg and said top leg and said depending leg are welded together.

16. The invention of claim 1 wherein said web means is slideably engaged along said at least two said rods.

17. A safety system for a ground level hatch frame opening over a subterranean chamber, comprising a ground level hatch frame, said ground level hatch frame including a hatch frame opening, said hatch frame opening including internal support means, said internal support means horizontally disposed in said hatch frame opening for supporting said hatch frame cover thereover, and a safety web assembly, said safety web assembly horizontally emplaced on said internal support means, said safety web assembly comprising at least two rigid rods, each said rigid rod having a first end and a second end, said at least two rigid rods having lengths to span said hatch frame opening, each rigid rod including attaching means at each said end, said attaching means securely engageable with said internal support means, web means, said web means openwork and slidably engaged on said at least two said rigid rods between said ends, said web means having substantially the length and width of said hatch frame opening, and said web means slidable on said rigid rods to optionally cover said hatch frame opening or to uncover said hatch frame opening.

18. The invention of claim 17 including slideable attaching means, said slideable attaching means engaged on at least two said rigid rods, said web means engaged by said attaching means and slideable along at least two said rigid rods.

19. The invention of claim 18 wherein said web means is a net.

20. The invention of claim 18 wherein said slidable attaching means is a clamp.

21. The invention of claim 20 wherein said clamp is a horse shoe clamp.

22. The invention of claim 21 wherein said horse shoe clamp includes a closure.

23. The invention of claim 17 wherein at least one of said rod end attaching means is a bracket.

24. The invention of claim 23 wherein said bracket is in a substantially inverted U shape.

25. The invention of claim 24 wherein said bracket includes an outside short leg, a top leg, said top leg connected to said short leg, and a depending leg spaced away from said outside short leg and depending from said top leg, said depending leg attached to one end of said rigid rod.

26. The invention of claim 25 wherein said outside short leg and said depending leg are joined to said top leg by screw means.

27. The invention of claim 25 wherein said outside short leg and said top leg and said depending leg are welded together.

28. The invention of claim 17 wherein said internal support means is rectangular.

29. The invention of claim 17 wherein said internal support means includes at least one ledge.

30. The invention of claim 29 wherein said at least one ledge includes at least one declivity for receiving a rod end attaching means securely engaged therein.

31. The invention of claim 17 wherein said support means includes at least one trough.

32. The invention of claim 17 including a hatch cover configured so as to fit horizontally into said support means and to lie above and completely cover said safety web assembly when in place.

* * * * *